US007487760B2

(12) United States Patent
Okayasu et al.

(10) Patent No.: US 7,487,760 B2
(45) Date of Patent: Feb. 10, 2009

(54) FUEL SUPPLY APPARATUS FOR INTERNAL COMBUSTION ENGINE

(75) Inventors: Kouji Okayasu, Wako (JP); Masaki Nishio, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/824,811

(22) Filed: Jul. 3, 2007

(65) Prior Publication Data

US 2008/0006247 A1 Jan. 10, 2008

(30) Foreign Application Priority Data

Jul. 4, 2006 (JP) ..... 2006-184478

(51) Int. Cl.
*F02M 37/04* (2006.01)
*F02M 37/00* (2006.01)
*F02M 37/14* (2006.01)

(52) U.S. Cl. ..... 123/495

(58) Field of Classification Search ..... 123/497, 123/514, 456, 458, 357, 446
See application file for complete search history.

(56) References Cited

U.S. PATENT DOCUMENTS 5,085,193 A * 2/1992 Morikawa ..... 123/458
5,694,902 A * 12/1997 Miwa et al. ..... 123/493
5,699,772 A * 12/1997 Yonekawa et al. ..... 123/497
5,762,048 A * 6/1998 Yonekawa ..... 123/514
5,947,098 A * 9/1999 Hosokawa et al. ..... 123/679
6,024,064 A * 2/2000 Kato et al. ..... 123/179.17
6,223,731 B1 * 5/2001 Yoshiume et al. ..... 123/497
7,146,967 B2 * 12/2006 Hosoya ..... 123/497
2004/0154594 A1 * 8/2004 Miyashita ..... 123/458
2005/0045153 A1 * 3/2005 Ishikawa et al. ..... 123/458
2005/0229906 A1 * 10/2005 Hosoya ..... 123/457
2005/0252200 A1 11/2005 Oono
2006/0207563 A1 9/2006 Kinose

FOREIGN PATENT DOCUMENTS

EP 136686 A2 9/2001
JP H07-72511 B 8/1995
JP 2003-184616 7/2003

* cited by examiner

*Primary Examiner*—Stephen K Cronin
*Assistant Examiner*—Arnold Castro
(74) *Attorney, Agent, or Firm*—Lahive & Cockfield, LLP

(57) ABSTRACT

A fuel supply apparatus for an internal combustion engine is disclosed. The fuel supply apparatus includes a fuel pump driven by the engine, a pressure accumulating device for retaining the fuel pressurized by the fuel pump, a relief device which opens when a fuel pressure in the pressure accumulating device exceeds a predetermined upper limit pressure. An injection device is connected to the pressure accumulating device and injects fuel into a combustion chamber of the engine. A fuel pressure in the pressure accumulating device is detected. A discharge amount of the fuel pump is controlled so that the detected fuel pressure coincides with a target fuel pressure. The target fuel pressure is reduced when the detected fuel pressure is equal to or greater than a predetermined fuel pressure, to suppress opening of the relief device.

4 Claims, 2 Drawing Sheets

FUEL SUPPLY APPARATUS FOR INTERNAL COMBUSTION ENGINE

BACKGROUND OF THE INVENTION

1. Field of the Invention

The present invention relates to a fuel supply apparatus for an internal combustion engine, and particularly to a fuel supply apparatus for injecting fuel directly into a combustion chamber of the internal combustion engine.

2. Description of the Related Art

Japanese Patent Laid-open (Kokoku) No. H07-72511 discloses a fuel supply apparatus in which fuel pressurized by a fuel pump is retained in a fuel accumulator (common-rail), and the pressurized fuel is supplied from the fuel accumulator to a fuel injection valve. A technique for rapidly converging a fuel pressure in the fuel accumulator to a target fuel pressure is disclosed. According to this apparatus, a discharge amount of the fuel pump is controlled to the minimum and an electromagnetic valve provided in the fuel accumulator is opened, to rapidly converge the fuel pressure in the fuel accumulator to the target fuel pressure, when the fuel pressure in the fuel accumulator exceeds the target fuel pressure by a predetermined value.

There is a problem described below in a case where a common-rail, which is provided with a relief valve which opens when the fuel pressure becomes abnormally high, is used and it takes a long time period for the relief valve to return to the initial closed state once the relief valve opens.

The fuel pressure in the common-rail temporarily drops if air mixes in the fuel in a passage from the fuel tank to the common-rail. Consequently, a feedback control for increasing the discharge amount of the fuel pump is performed when the fuel pressure in the common-rail drops. In such state, if the mixed air vanishes, the discharge amount of the fuel pump becomes excessive. Accordingly, the fuel pressure in the common-rail abnormally rises, to open the relief valve. Consequently, operating performance of the engine deteriorates in the period until the relief valve returns to the initial closed state. In the technique disclosed in Japanese Patent Laid-open (Kokoku) No. H07-72511, the electromagnetic valve provided in the fuel accumulator corresponds to the relief valve and the actual fuel pressure is rapidly converged to the target fuel pressure by opening the electromagnetic valve. That is, the technique disclosed in Japanese Patent Laid-open (Kokoku) No. H07-72511 does not tend to avoid opening of the electromagnetic valve (relief valve), and hence cannot prevent the above-described inconvenience caused by opening of the relief valve.

SUMMARY OF THE INVENTION

The present invention was made contemplating the above-described drawback. An object of the present invention is to provide a fuel supply apparatus for an internal combustion engine, which can certainly prevent abnormal rise in the fuel pressure that causes opening of the relief valve provided in the common-rail, thereby maintaining good engine operating performance.

To attain the above-described object, the present invention provides a fuel supply apparatus for an internal combustion engine having a fuel pump (6) driven by the internal combustion engine, pressure accumulating means (10) for retaining fuel pressurized by the fuel pump (6), relief means (11) for opening when a fuel pressure (PF) in the pressure accumulating means (10) exceeds a predetermined upper limit pressure (PFMAX), and injection means (14) connected to the pressure accumulating means (10) for injecting fuel into a combustion chamber of the engine. The fuel supply apparatus further includes fuel pressure detecting means (21) and fuel pressure control means (7, 20). The fuel pressure detecting means (21) detects the fuel pressure (PF) in the pressure accumulating means (10). The fuel pressure control means controls a discharge amount of the fuel pump (6) so that the detected fuel pressure (PF) coincides with a target fuel pressure (PFCMD). The fuel pressure control means reduces the target fuel pressure (PFCMD) when the detected fuel pressure (PF) is equal to or greater than a first predetermined fuel pressure (PFTH), to suppress opening of the relief means (11).

With this configuration, the discharge amount of the fuel pump is controlled so that the detected fuel pressure coincides with the target fuel pressure. When the detected fuel pressure is equal to or greater than the first predetermined value, the target fuel pressure is reduced, thereby suppressing opening of the relief means. Therefore, if a situation occurs where air mixes in the fuel and the mixed air thereafter vanishes, the discharge amount of the fuel pump is decreased by reducing the target fuel pressure. Accordingly, the relief means is not opened and good engine operating performance can be maintained.

Preferably, the fuel supply apparatus further includes basic target fuel pressure calculating means for calculating a basic target fuel pressure (PFMAP) according to an operating condition (NE, QINJ) of the engine. The fuel pressure control means sets the target fuel pressure (PFCMD) to the basic target fuel pressure (PFMAP) when the detected fuel pressure (PF) is lower than the first predetermined fuel pressure (PFTH), and sets the target fuel pressure (PFCMD) to a value obtained by subtracting a predetermined value (DPF0) from the basic target fuel pressure (PFMAP) when the detected fuel pressure (PF) is equal to or greater than the first predetermined fuel pressure (PFTH).

Alternatively, the fuel pressure control means sets the target fuel pressure (PFCMD) to a value obtained by subtracting a subtraction amount (ΔPFCMD) from the basic target fuel pressure (PFMAP) when the detected fuel pressure (PF) is equal to or greater than the first predetermined fuel pressure (PFTH). The subtraction amount (ΔPFCMD) is set so as to gradually increase from "0" to a first value (DPF1) when the detected fuel pressure (PF) is between the first predetermined fuel pressure (PFTH) and a second predetermined fuel pressure (PFH) which is higher than the first predetermined fuel pressure (PFTH), and the subtraction amount (ΔPFCMD) is set to a second value (DPF0) which is greater than the first value (DPF1) when the detected fuel pressure (PF) is equal to or greater than the second predetermined fuel pressure (PFH).

DETAILED DESCRIPTION OF THE PREFERRED EMBODIMENTS

Preferred embodiments of the present invention will now be described with reference to the drawings.

Figure 1:
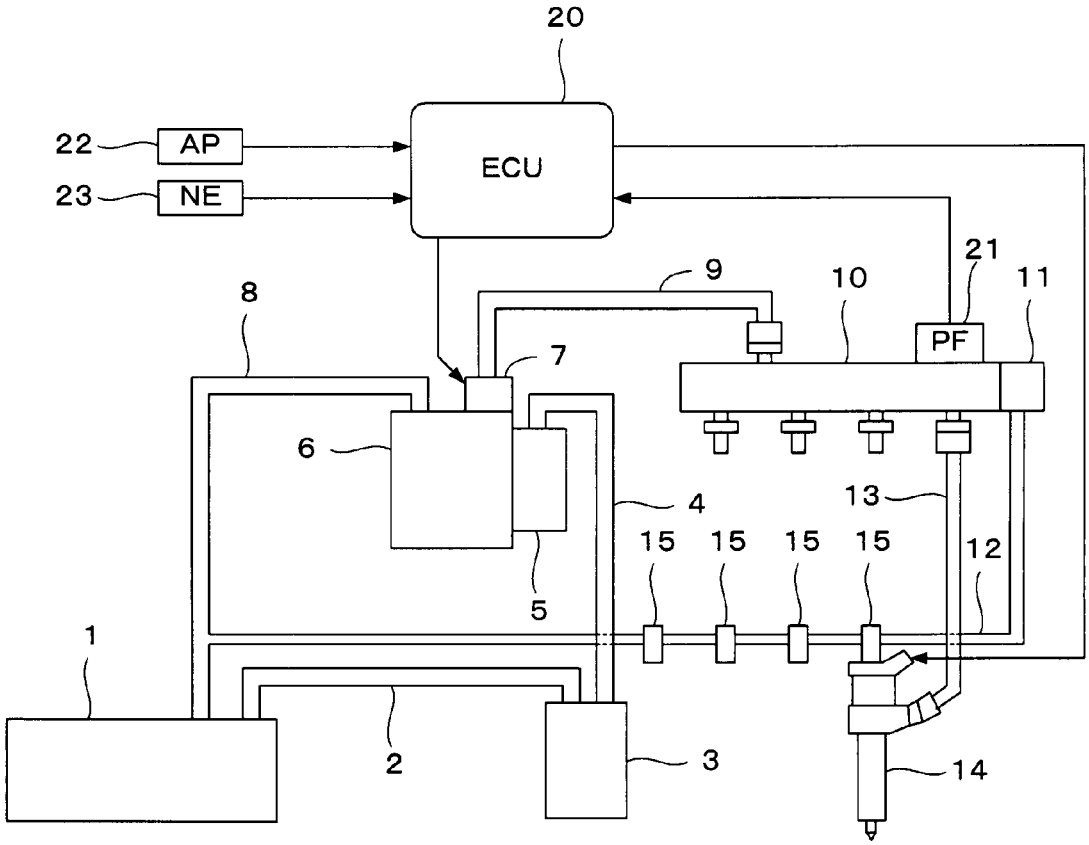
FIG. 1 shows a configuration of a fuel supply apparatus according to one embodiment of the present invention.

FIG. 1 is a schematic diagram showing a configuration of a fuel supply apparatus according to one embodiment of the present invention. The fuel supply apparatus supplies fuel to an internal combustion engine (not shown) (hereinafter referred to as "engine") through a fuel injection valve 14 provided in each combustion chamber of the engine. In this embodiment, the engine is a 4-cylinder engine, but the fuel injection valve 14 is illustrated corresponding to only one cylinder.

A fuel tank 1 is connected to a strainer 3 through a fuel supply passage 2, and the strainer 3 is connected to a gear pump 5 through a fuel supply passage 4. The gear pump 5 is configured in one body together with a high-pressure pump 6, and the fuel sucked up by the gear pump 5 is supplied to the high-pressure pump 6 and pressurized. The gear pump 5 and the high-pressure pump 6 are driven by the above-mentioned engine.

The high-pressure pump 6 is provided with a discharge amount control valve 7, and the fuel which passes the discharge amount control valve 7 is supplied to a common-rail 10 through a high-pressure passage 9, and is retained. The high-pressure pump 6 is further connected to the fuel tank 1 through a return passage 8, and the fuel which overflows from the high-pressure pump 6 is returned to the fuel tank 1 through the return passage 8.

The common-rail 10 is provided with a relief valve 11. The relief valve 11 opens when a fuel pressure PF in the common-rail 10 exceeds a predetermined upper limit pressure PFMAX (e.g., 185 MPa). Once the relief valve 11 opens, the relief valve 11 keeps the open state until the fuel pressure PF becomes lower than a predetermined lower limit pressure PFMIN (e.g., 12 MPa), and closes when the fuel pressure PF becomes lower than the predetermined lower limit pressure PFMIN. The relief valve 11 is connected to the return passage 8 through a return passage 12. The fuel, which flows out when the relief valve 11 opens, is returned to the fuel tank 1 through the return passages 12 and 8. The common-rail 10 is provided with a fuel pressure sensor 21 for detecting the fuel pressure PF, and a detection signal is supplied to an electronic control unit (hereinafter referred to as "ECU") 20.

The fuel injection valve 14 is connected to the common-rail 10 through a fuel passage 13. Further, the fuel injection valve 14 is electrically connected to the ECU 20, and opening and closing of the fuel injection valve 14 is controlled by the ECU 20. The fuel injection valve 14 is connected to the return passage 12 at a connecting portion 15, and fuel overflowing from the fuel injection valve 14 is returned to the fuel tank 1 through the return passage 12. The connecting portions 15 corresponding to the other three engine cylinders are shown in FIG. 1, but the fuel injection valves 14 corresponding to the other three engine cylinders are omitted.

An accelerator sensor 22 for detecting an operation amount AP of an accelerator of the vehicle driven by the engine and an engine rotational speed sensor 23 for detecting a rotational speed NE of the above-described engine are connected to the ECU 20 and the detection signals of these sensors are supplied to the ECU 20.

The ECU 20 calculates a target fuel pressure PFCMD according to the accelerator operation amount AP and the engine rotational speed NE, and controls the discharge amount control valve 7 so that the detected fuel pressure PF coincides with the target fuel pressure PFCMD.

The ECU 20 includes an input circuit, a central processing unit (hereinafter referred to as "CPU"), a memory circuit, and an output circuit. The input circuit performs various functions, including shaping the waveform from of input signals from above-described sensors and other sensors not shown, correcting the voltage levels of the input signals to a predetermined level, and converting analog signal values into digital values. The memory circuit preliminarily stores various operation programs to be executed by the CPU and stores the results of computations or the like by the CPU. The output circuit supplies control signals to the discharge amount control valve 7, the fuel injection valve 14, and the like.

Figure 2:
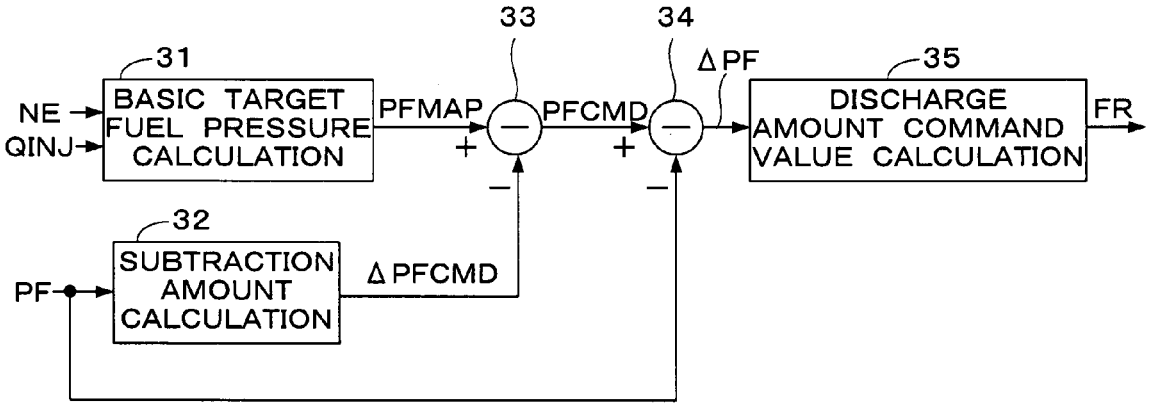
FIG. 2 is a block diagram showing a configuration of a module which performs a fuel pressure control.

FIG. 2 is a block diagram showing a configuration of a module which calculates a discharge amount command value FR for the discharge amount control valve 7. The function of this module is actually realized by the operation process by the CPU in the ECU 20.

The module shown in FIG. 2 includes a basic target fuel pressure calculation block 31, a subtraction amount calculation block 32, a first and a second subtracting block 33 and 34, and a discharge amount command value calculation block 35. The basic target fuel pressure calculation block 31 retrieves a PF map according to the engine rotational speed NE and the accelerator operation amount AP, to calculate a basic target fuel pressure PFMAP. The basic target fuel pressure PFMAP is set to a value equal to or less than a target fuel pressure upper limit value PFCMDH (e.g., 160 MPa) which is lower than the predetermined upper limit pressure PFMAX.

The subtraction amount calculation block 32 calculates a subtraction amount ΔPFCMD according to the detected fuel pressure PF. Specifically, the subtraction amount ΔPFCMD is set to "0" when the fuel pressure PF is lower than a predetermined fuel pressure PFTH, and the subtraction amount ΔPFCMD is set to a predetermined value DPF0 (e.g., 150 MPa) when the fuel pressure PF is equal to or greater than the predetermined fuel pressure PFTH. The predetermined fuel pressure PFTH is set to a value (e.g., 167 MPa) which is slightly higher than the above-described target fuel pressure upper limit value PFCMDH and lower than the predetermined upper limit pressure PFMAX.

The first subtracting block 33 subtracts the subtraction amount ΔPFCMD from the basic target fuel pressure PFMAP, to calculate the target fuel pressure PFCMD. Therefore, when the subtraction amount ΔPFCMD is equal to "0", the target fuel pressure PFCMD coincides with the basic target fuel pressure PFMAP. When the subtraction amount ΔPFCMD is set to the predetermined value DPF0, the target fuel pressure PFCMD is modified to a value less than the basic target fuel pressure PFMAP by the predetermined value DPF0.

The second subtracting block 34 subtracts the detected fuel pressure PF from the target fuel pressure PFCMD, to calculate a difference ΔPF. The discharge amount command value calculation block 35 calculates the discharge amount command value FR with the PID (proportional, integral, and differential) control method so that the difference ΔPF becomes "0".

The ECU 20 supplies a drive signal according to the discharge amount command value FR to the discharge amount control valve 7, and controls the discharge amount of the high-pressure pump 6.

As described above, in this embodiment, when the detected fuel pressure PF becomes equal to or greater than the predetermined fuel pressure PFTH, the target fuel pressure PFCMD is reduced by the predetermined value DPF0, thereby reducing the fuel pressure PF. Accordingly, an abnormal rise in the fuel pressure that causes opening of the relief valve 11 can be certainly prevented, to maintain good operating performance of the engine.

In this embodiment, the high-pressure pump 6 corresponds to the fuel pump, the common-rail 10 corresponds to the pressure accumulating means, the relief valve 11 corresponds to the relief means, the fuel injection valve 14 corresponds to the injection means, and the fuel pressure sensor 21 corresponds to the fuel pressure detecting means. Further, the discharge amount control valve 7 and the ECU 20 correspond to the fuel pressure control means.

Figure 3:
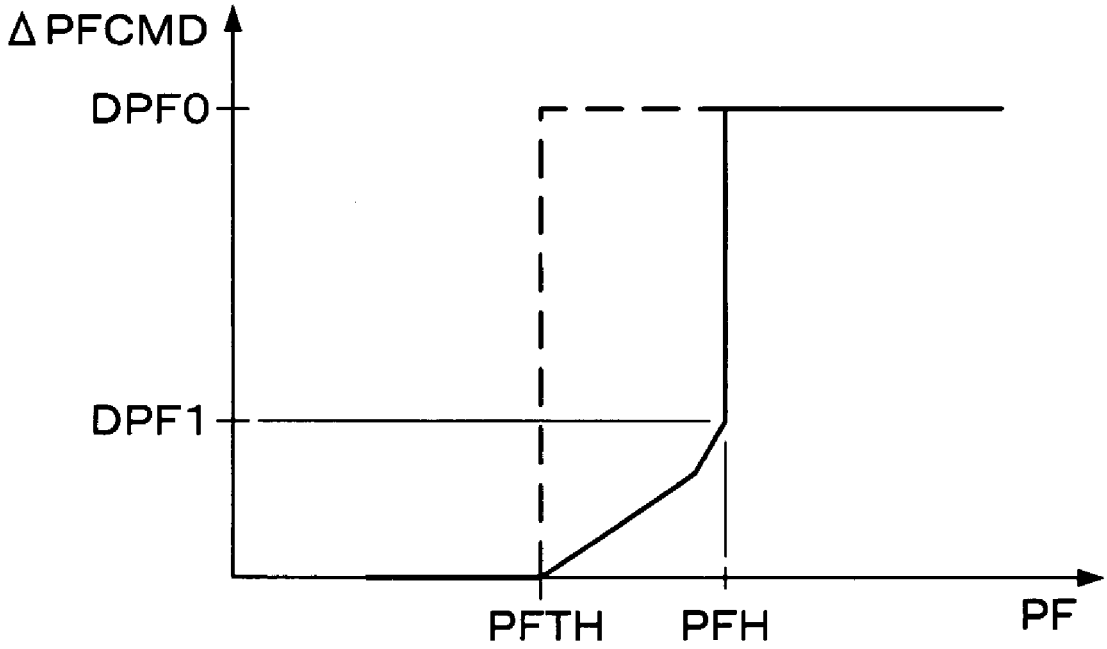
FIG. 3 shows a table for calculating a subtraction amount.

In the embodiment described above, the subtraction amount ΔPFCMD is set to a value as shown by the dashed line in FIG. 3. Alternatively, as shown by the solid line in FIG. 3, the subtraction amount ΔPFCMD may be set so as to increase gradually from "0" to a predetermined value DPF1 until the fuel pressure PF reaches a predetermined pressure PFH (e.g., 171 MPa), and set to the predetermined value DPF0 when the fuel pressure PF reaches the predetermined pressure PFH.

The present invention can be applied also to a fuel supply apparatus for internal combustion engine with more than four engine cylinders, for example, internal combustion engines with five engine cylinders, six engine cylinders, eight engine cylinders, twelve engine cylinders and the like. Further, the present invention is also applicable to a fuel supply apparatus for, a watercraft propulsion engine such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A fuel supply apparatus for an internal combustion engine, comprising:

a fuel pump driven by said engine;

pressure accumulating means for retaining fuel pressurized by said fuel pump;

relief means for opening when a fuel pressure in said pressure accumulating means exceeds a predetermined upper limit pressure;

injection means connected to said pressure accumulating means for injecting fuel into a combustion chamber of said engine;

fuel pressure detecting means for detecting said fuel pressure in said pressure accumulating means;

basic target fuel pressure calculating means for calculating a basic target fuel pressure according to an operating condition of said engine; and fuel pressure control means for controlling a discharge amount of said fuel pump so that the detected fuel pressure coincides with a target fuel pressure, wherein said fuel pressure control means reduces the target fuel pressure when the detected fuel pressure is equal to or greater than a first predetermined fuel pressure, to suppress opening of said relief means, wherein said fuel pressure control means sets the target fuel pressure to the basic target fuel pressure when the detected fuel pressure is lower than the first predetermined fuel pressure, and sets the target fuel pressure to a value obtained by subtracting a predetermined value from the basic target fuel pressure when the detected fuel pressure is equal to or greater than the first predetermined fuel pressure.

2. A fuel supply apparatus for an internal combustion engine, comprising:

a fuel pump driven by said engine;

pressure accumulating means for retaining fuel pressurized by said fuel pump;

relief means for opening when a fuel pressure in said pressure accumulating means exceeds a predetermined upper limit pressure;

injection means connected to said pressure accumulating means for injecting fuel into a combustion chamber of said engine;

fuel pressure detecting means for detecting said fuel pressure in said pressure accumulating means;

basic target fuel pressure calculating means for calculating a basic target fuel pressure according to an operating condition of said engine; and fuel pressure control means for controlling a discharge amount of said fuel pump so that the detected fuel pressure coincides with a target fuel pressure, wherein said fuel pressure control means reduces the target fuel pressure when the detected fuel pressure is equal to or greater than a first predetermined fuel pressure, to suppress opening of said relief means, wherein said fuel pressure control means sets the target fuel pressure to the basic target fuel pressure when the detected fuel pressure is lower than the first predetermined fuel pressure, and sets the target fuel pressure to a value obtained by subtracting a subtraction amount from the basic target fuel pressure when the detected fuel pressure is equal to or greater than the first predetermined fuel pressure, wherein the subtraction amount is set so as to gradually increase from "0" to a first value when the detected fuel pressure is between the first predetermined fuel pressure and a second predetermined fuel pressure which is higher than the first predetermined fuel pressure, and the subtraction amount is set to a second value which is greater than the first value when the detected fuel pressure is equal to or greater than the second predetermined fuel pressure.

3. A fuel supply method for an internal combustion engine, comprising the steps of:

pressurizing fuel by a fuel pump driven by said engine;

retaining fuel pressurized by said fuel pump in a pressure accumulating device, said pressure accumulating device having a relief device for opening when a fuel pressure in said pressure accumulating device exceeds a predetermined upper limit pressure;

detecting said fuel pressure in said pressure accumulating device;

controlling a discharge amount of said fuel pump so that the detected fuel pressure coincides with a target fuel pressure;

calculating a basic target fuel pressure according to an operating condition of said engine; and injecting fuel into a combustion chamber of said engine by a fuel injection device connected to said pressure accumulating device, wherein the target fuel pressure is reduced when the detected fuel pressure is equal to or greater than a first predetermined fuel pressure, to suppress opening of said relief device, wherein the target fuel pressure is set to the basic target fuel pressure when the detected fuel pressure is lower than the first predetermined fuel pressure, and the target fuel pressure is set to a value obtained by subtracting a predetermined value from the basic target fuel pressure when the detected fuel pressure is equal to or greater than the first predetermined fuel pressure.

4. A fuel supply method for an internal combustion engine, comprising the steps of:

pressurizing fuel by a fuel pump driven by said engine;

retaining fuel pressurized by said fuel pump in a pressure accumulating device, said pressure accumulating device having a relief device for opening when a fuel pressure in said pressure accumulating device exceeds a predetermined upper limit pressure;

detecting said fuel pressure in said pressure accumulating device;

controlling a discharge amount of said fuel pump so that the detected fuel pressure coincides with a target fuel pressure;

calculating a basic target fuel pressure according to an operating condition of said engine; and injecting fuel into a combustion chamber of said engine by a fuel injection device connected to said pressure accumulating device, wherein the target fuel pressure is reduced when the detected fuel pressure is equal to or greater than a first predetermined fuel pressure, to suppress opening of said relief device, wherein the target fuel pressure is set to the basic target fuel pressure when the detected fuel pressure is lower than the first predetermined fuel pressure, and the target fuel pressure is set to a value obtained by subtracting a subtraction amount from the basic target fuel pressure when the detected fuel pressure is equal to or greater than the first predetermined fuel pressure, wherein the subtraction amount is set so as to gradually increase from "0" to a first value when the detected fuel pressure is between the first predetermined fuel pressure and a second predetermined fuel pressure which is higher than the first predetermined fuel pressure, and the subtraction amount is set to a second value which is greater than the first value when the detected fuel pressure is equal to or greater than the second predetermined fuel pressure.

* * * * *